US009950848B2

(12) United States Patent
Zhou

(10) Patent No.: US 9,950,848 B2
(45) Date of Patent: Apr. 24, 2018

(54) RESEALABLE PACKING-LIST POUCH

(71) Applicant: Federal Express Corporation, Memphis, TN (US)

(72) Inventor: Yongquan Zhou, Collierville, TN (US)

(73) Assignee: Federal Express Corporation, Memphis, TN (US)

( * ) Notice: Subject to any disclaimer, the term of this patent is extended or adjusted under 35 U.S.C. 154(b) by 0 days.

(21) Appl. No.: 15/254,937

(22) Filed: Sep. 1, 2016

(65) Prior Publication Data

US 2018/0057234 A1 Mar. 1, 2018

(51) Int. Cl.

| | |
|---|---|
| ***B65D 75/54*** | (2006.01) |
| ***B65D 27/16*** | (2006.01) |
| ***B65D 33/00*** | (2006.01) |
| ***B31B 1/62*** | (2006.01) |
| ***B31B 1/72*** | (2006.01) |
| ***B31B 1/90*** | (2006.01) |

(52) U.S. Cl.

CPC ..... *B65D 75/545* (2013.01); *B31B 1/62* (2013.01); *B31B 1/72* (2013.01); *B31B 1/90* (2013.01); *B65D 27/16* (2013.01); *B65D 33/007* (2013.01)

(58) Field of Classification Search

CPC .... B31B 1/62; B31B 1/70; B31B 1/90; B65D 25/20; B65D 25/205; B65D 27/16; B65D 33/00; B65D 33/007; B65D 75/54; B65D 75/545; G09F 3/00; G09F 3/02; G09F 3/18; G09F 3/185; G09F 3/0288; G09F 3/0289

USPC ..... 206/459.5, 484–484.2; 40/638; 283/81, 283/103, 105; 383/86, 87; 428/40.1, 43

See application file for complete search history.

(56) References Cited

U.S. PATENT DOCUMENTS

| | | | | |
|---|---|---|---|---|
| 2,620,842 A | | 12/1952 | Hoeppner et al. | |
| 2,925,675 A | * | 2/1960 | Lumpkin | G09F 3/18 40/638 |
| 3,147,674 A | | 9/1964 | Hoeppner | |
| 3,327,416 A | * | 6/1967 | Sanford | G09F 3/185 229/74 |
| 3,525,470 A | * | 8/1970 | Carrigan | B65D 75/545 229/74 |
| 4,103,821 A | * | 8/1978 | Gartshore | B65D 27/00 229/74 |
| 4,332,347 A | | 6/1982 | Clayton | |
| 5,584,580 A | | 12/1996 | Vetter | |

(Continued)

FOREIGN PATENT DOCUMENTS

| | | | | |
|---|---|---|---|---|
| GB | 1604156 | | 12/1981 | |
| JP | 200062802 A | * | 2/2000 | B65D 33/00 |

OTHER PUBLICATIONS

International Search Report and Written Opinion in International Application No. PCT/US2017/049153, dated Feb. 5, 2018, 18 pages.

*Primary Examiner* — Bryon Gehman
(74) *Attorney, Agent, or Firm* — Fish & Richardson P.C.

(57) ABSTRACT

Methods, systems, and apparatus, including a packing-list-pouch comprising a back sheet and a front sheet attached to a pocket, a protective lip sheet attached to cover a top edge of the front sheet, and a removable release liner attached to an exterior surface of the back sheet via an adhesive coating. The packing-list-pouch may include a flap sheet attached to the protective lip sheet and an adhesive strip configured to fasten a bottom portion of the flap sheet to the front sheet to form a resealable closure over an opening of the pocket and the protective lip sheet.

20 Claims, 6 Drawing Sheets

(56) References Cited

U.S. PATENT DOCUMENTS

| | | | | |
|---|---|---|---|---|
| 6,723,408 | B2 * | 4/2004 | Hillemann | B65D 27/16<br>383/54 |
| 2003/0211268 | A1 | 11/2003 | Hilleman et al. | |
| 2006/0043159 | A1 * | 3/2006 | Roberts | B65D 27/06<br>229/74 |
| 2011/0164838 | A1 * | 7/2011 | Chen | B65D 27/34<br>383/211 |
| 2014/0270584 | A1 * | 9/2014 | Exner | B65D 33/1691<br>383/86 |

* cited by examiner

RESEALABLE PACKING-LIST POUCH

BACKGROUND

A resealable packing-list-pouch may be employed in logistics transportation as an instrument to contain shipping documents while the pouch is attached to a package as the package travels through a distribution channel. Due to the roughness of the shipping environment the seal may be rubbed open and/or ripped off, which may result in the loss of and/or damage to the shipping documents.

SUMMARY

This specification relates to resealable packing-list-pouches. More specifically, some implementations of the present specification relate to resealable, self-attaching packing-list-pouches that are particularly adapted for receiving and containing shipping documents as well as attaching to a receiving surface such as a box, carton, or other container. Some implementations comprise a protective lip that forms a portion of a pocket and provides a redundant barrier, in addition to a resealable flap, to contain shipping documents placed within the pocket.

In general, innovative aspects of the subject matter described in this specification can be embodied in a resealable packing-list-pouch that includes a back sheet and a front sheet attached to the back sheet at respective side and bottom edges to form a pocket between the back sheet and the front sheet such that a top edge of the back sheet extends beyond a top edge of the front sheet to form an opening of the pocket. The resealable packing-list-pouch also may include a protective lip sheet attached to the back sheet at respective top edges. The protective lip sheet attaches to the back sheet such that side edges of the protective lip sheet connect to upper portions of the side edges of the back sheet to form a protective lip over the opening of the pocket, wherein a bottom edge of the protective lip sheet covers the top edge of the front sheet. The resealable packing-list-pouch may also include a flap sheet attached to the top edge of the protective lip sheet such that the top edge of the protective lip sheet is between the top edge of the flap sheet and the top edge of the back sheet as well as an a adhesive strip located on an exterior surface of the front sheet proximal to the bottom edge of the protective lip sheet such that the adhesive strip is configured to fasten a bottom portion of the flap sheet to the front sheet to form a resealable closure over the opening of the pocket and the protective lip sheet.

In another general aspect, innovative aspects of the subject matter described in this specification can be embodied in methods that include actions of forming a back sheet, a front sheet, a flap sheet, and a protective lip sheet out of a flexible plastic material. Forming a pocket by attaching the front sheet to the back sheet at respective side and bottom edges such that a top edge of the back sheet extends beyond a top edge of the front sheet to form an opening of the pocket. Attaching the protective lip sheet to the back sheet at respective top edges and such that side edges of the protective lip sheet affix to upper portions of the side edges of the back sheet to form a protective lip over the opening of the pocket, wherein a bottom edge of the protective lip sheet covers the top edge of the front sheet. Attaching the flap sheet to the top edge of the protective lip sheet such that the top edge of the protective lip sheet is between the top edge of the flap sheet and the top edge of the back sheet. Placing an adhesive strip on an exterior surface of the front sheet proximal to the bottom edge of the protective lip sheet such that the adhesive strip is configured to fasten a bottom portion of the flap sheet to the front sheet to form a resealable closure over the opening of the pocket and the protective lip sheet.

These and other implementations can each optionally include one or more of the following features.

Some implementations can include an adhesive coating located on an exterior surface of the back sheet as well as a release liner attached to the exterior surface of the back sheet via the adhesive coating such that the release liner is removable.

Some implementations can include a pressure sensitive material, such as acrylic, natural rubber, and/or synthetic rubber, to form the adhesive strip.

Some implementations can include the back sheet, the front sheet, the protective lip sheet, and the flap sheet being formed of a flexible plastic, such as polyethylene, which may be transparent material.

Some implementations can include attaching the front sheet, the back sheet, the protective lip sheet, and the flap sheet are attached via heat sealing or a permanent adhesive, such as an acrylic adhesive or a hot-melt adhesive.

Particular implementations of the subject matter described in this specification can be implemented so as to realize one or more of the following advantages. Implementations may improve the efficiency within a distribution channel for sending and receiving shipments by improving the likelihood that shipping documents are kept with corresponding shipments throughout the journey through the channel. Implementations may improve the performance of resealable packing-list-pouches employed within a distribution channel. Implementations may reduce the loss of shipments within a distribution channel.

The details of one or more implementations of the subject matter described in this specification are set forth in the accompanying drawings and the description below. Other features, aspects, and advantages of the subject matter will become apparent from the description, the drawings, and the claims.

DETAILED DESCRIPTION

Figure 1:
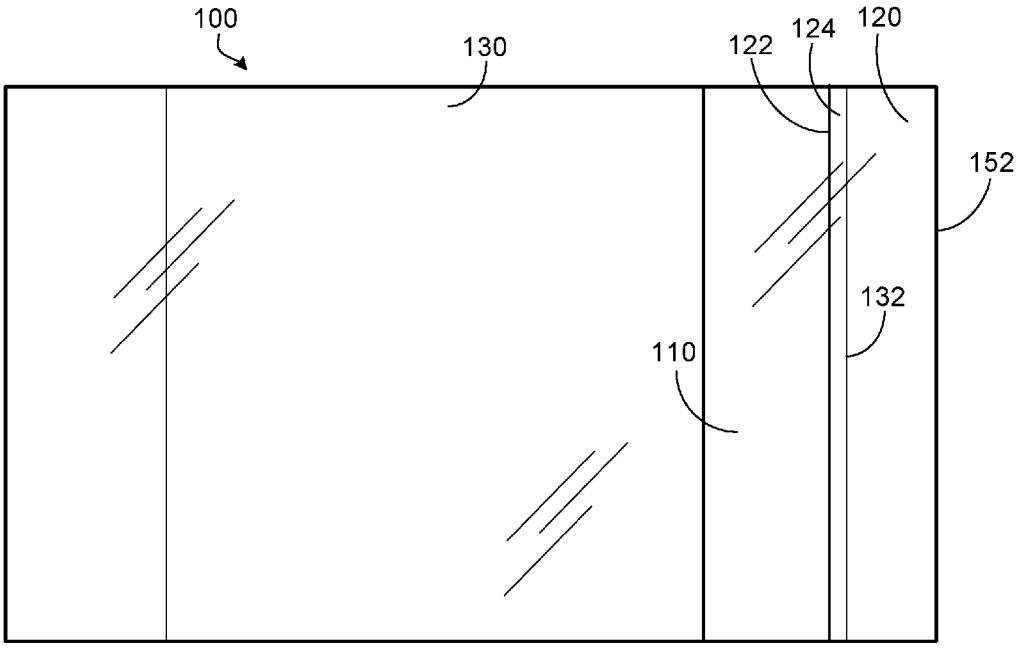
FIG. 1 illustrates a front view of an example resealable packing-list-pouch with the flap sheet closed.

A distribution channel for sending and receiving shipments generally employs shipping documents to route, sort, and track various shipments flowing through the channel. Shipping documents include, for example, air waybills, shipping labels, invoices, packing lists, and other paperwork related to a shipment. The shipping documents are placed inside a pouch that is attached to a receiving surface such as a package, box, carton, or other container to be shipped through the channel. To insure proper sorting, tracking, import/export, and ultimately, delivery, it is important to keep shipping documents with the shipment throughout the journey through the channel.

During shipping, a pouch may be opened and closed (i.e., resealed) several times (especially for international shipments) before a shipment reaches a final destination. For example, shipping documents may be removed from the pouch, one copy at a time, by a shipping company at various points of operations in transit though the channel, and/or by Custom agents at export and import ports. At the destination, the recipient opens the pouch and removes the shipping documents. Thus, a pouch may employ a resealable flap or closure to provide a means to access the shipping documents.

Such a resealable flap may fail during shipping because, for example, the flap is rubbed open (i.e., unsealed) or the flap is ripped off completely from the pouch. Failure may be due to the movement of the container containing the shipment and/or interactions with other containers and the sorting equipment (e.g., conveyers and slides). Should a flap fail, the shipping documents inside the pouch may slip out of the open pouch, which may result in the shipment being incorrectly sorted, lost, held at Customs, and/or delivered late.

Implementations of the present disclosure generally relate to resealable packing-list-pouches (i.e., packing-list-envelopes). More specifically, implementations of the present specification relate to resealable, self-attaching packing-list-pouches that are particularly adapted for receiving and containing shipping documents and attaching to a receiving surface. Implementations comprise a protective lip that forms a portion of a pocket and provides a redundant barrier, in addition to a resealable flap, to contain shipping documents placed within the pocket. The protective lip provides a line of mechanical, secure, and passive protection to an opening of the pocket and prevents shipping documents that are placed inside of the pocket via the opening from slipping out when the closure, created by sealing the resealable flap, fails.

In some implementations, the resealable packing-list-pouch comprises two panels or sheets, a resealable flap, and a protective lip. The components are made of thin flexible material and are heat sealed or otherwise bonded to one another to form a pocket for the placement of shipping documents. The protective lip attaches to the back panel such that a lower portion of the protective lip covers the top panel just below the opening of the pocket. The front flap is attached to the protective lip at the top edge of the packing-list-pouch. An adhesive material (e.g., pressure sensitive material or contact sensitive material), which may be in the form of a strip, is applied to a portion of the top surface of the top panel. The flap can be sealed, opened, and then resealed to the top surface of the top panel via the adhesive material. When sealed to the top surface of the top panel, the flap extends from the attached edge to cover the protective lip, the opening of the pocket, and a portion of the top panel. A lacquer material, such as silicon, may be applied to the bottom surface of the flap to prevent transfer of the adhesive material between the top surface of the top panel and the bottom surface of the flap. Additionally, a coating of adhesive material is applied on the back surface of the back panel and serves to attach the packing-list-pouch to a receiving surface. A sheet or multiple sheets of removable release liner are attached to the back panel via the coating of adhesive material and may be removed in order to attach the packing-list-pouch to a receiving surface via the coating of adhesive material.

Figure 2:
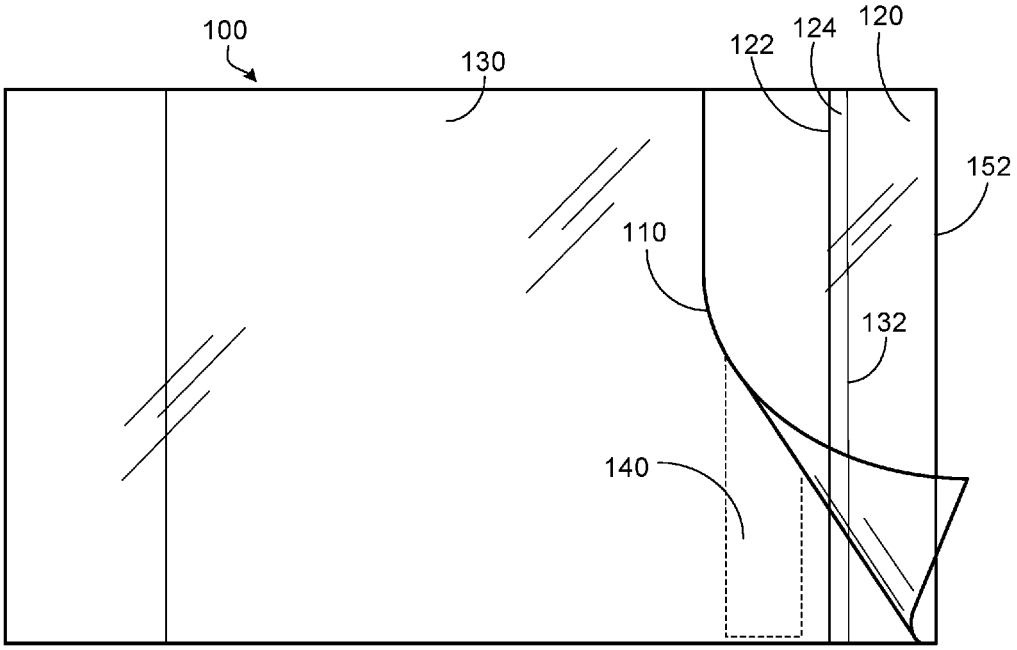
FIG. 2 illustrates a front view of an example resealable packing-list-pouch with the flap sheet beginning to open.
Figure 3:
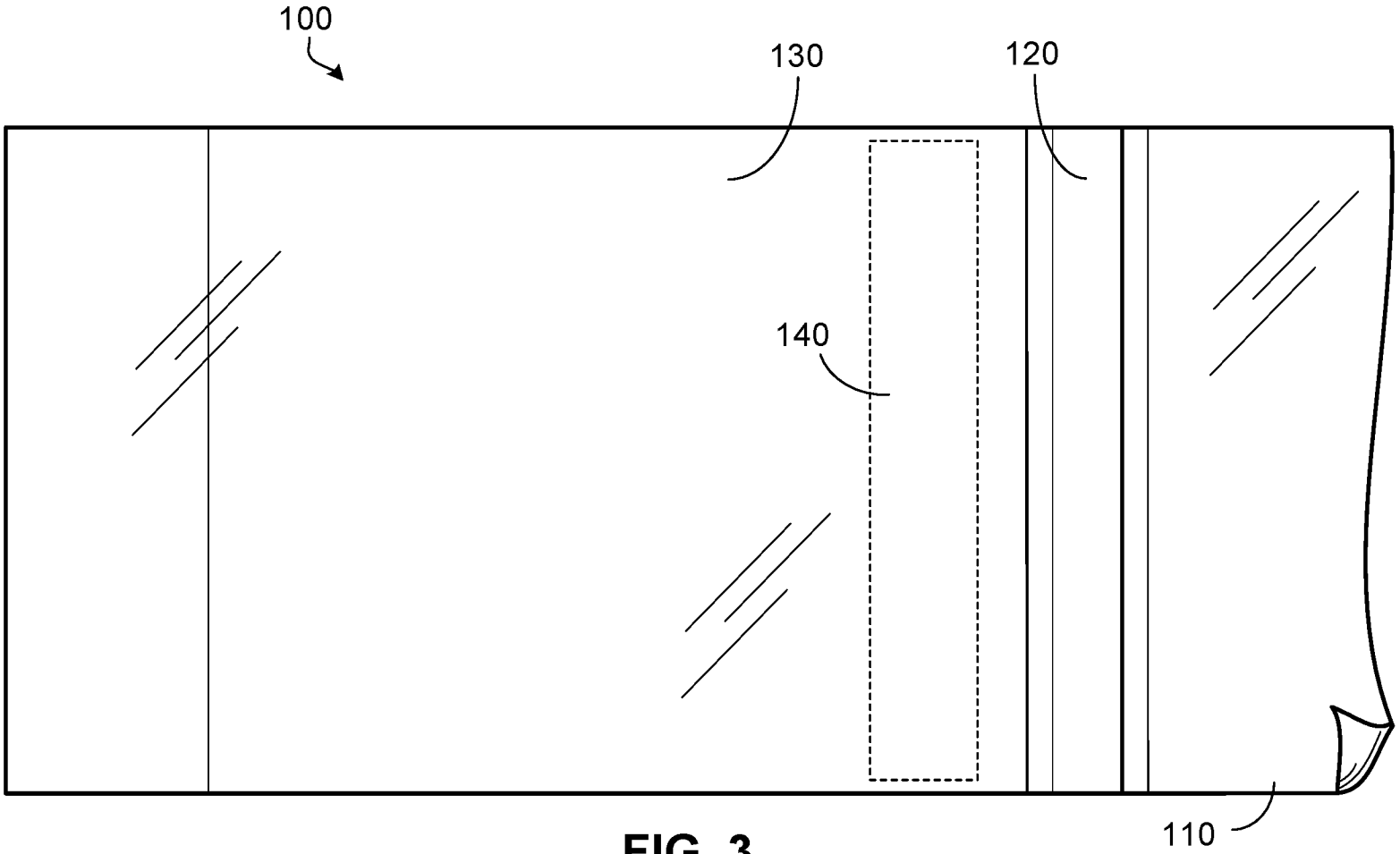
FIG. 3 illustrates a front view of an example resealable packing-list-pouch with the flap sheet completely open and protective lip sheet partially open.
Figure 4:
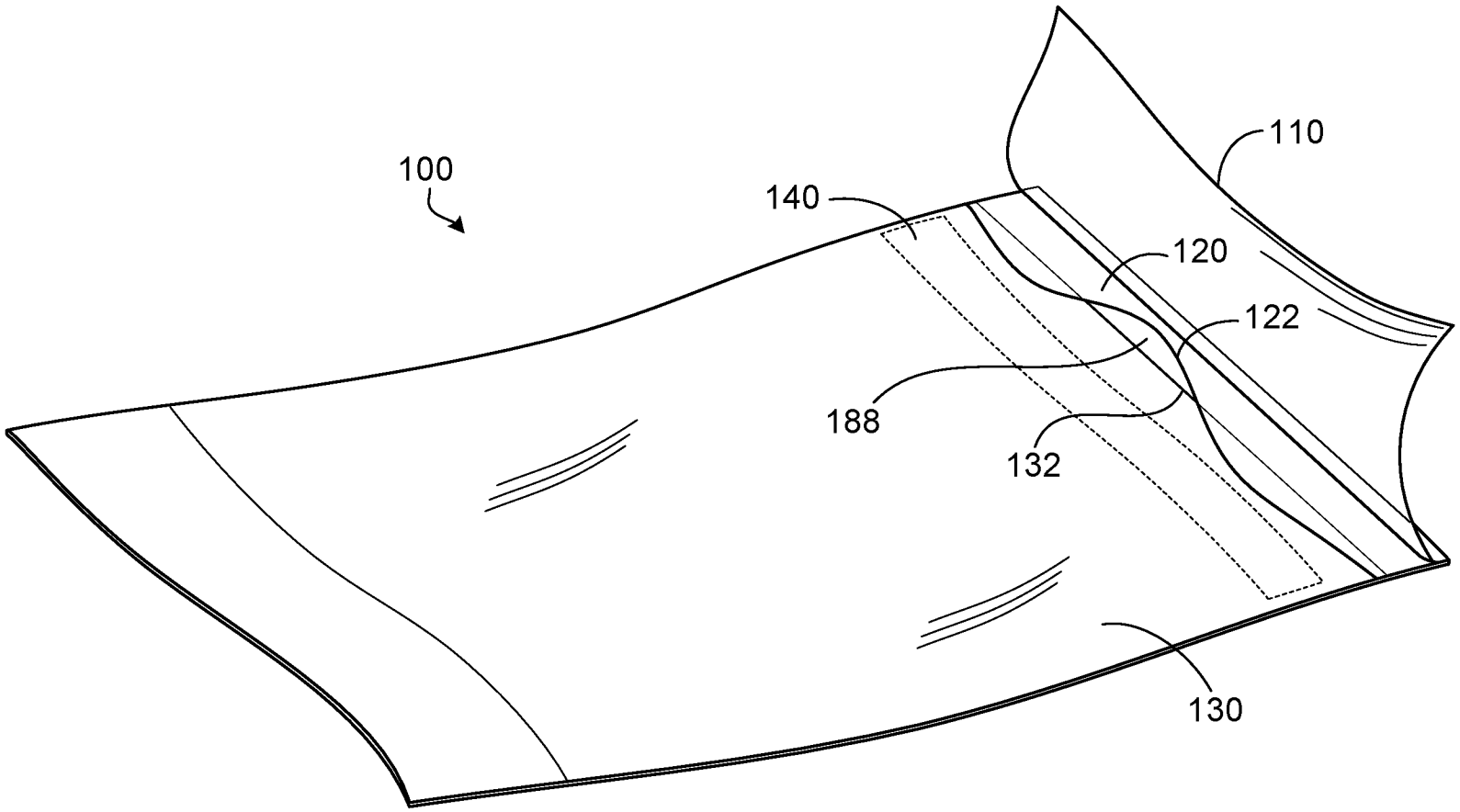
FIG. 4 illustrates a perspective view of the front side of an example resealable packing-list-pouch with the flap sheet open.
Figure 5:
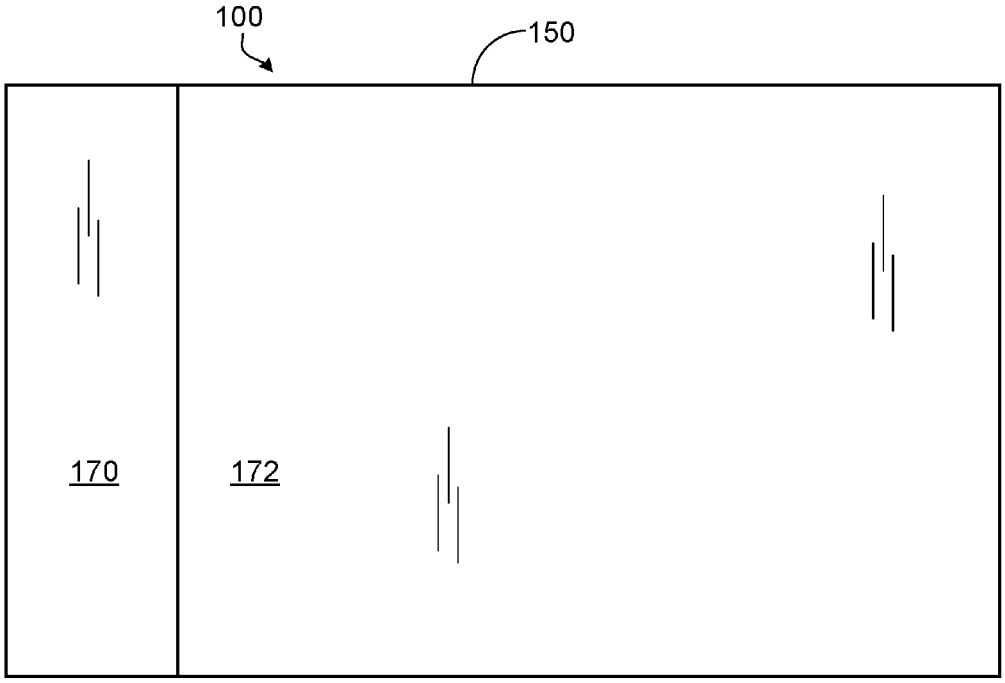
FIGS. 5 and 6 illustrate a back view of an example resealable packing-list-pouch.
Figure 6:
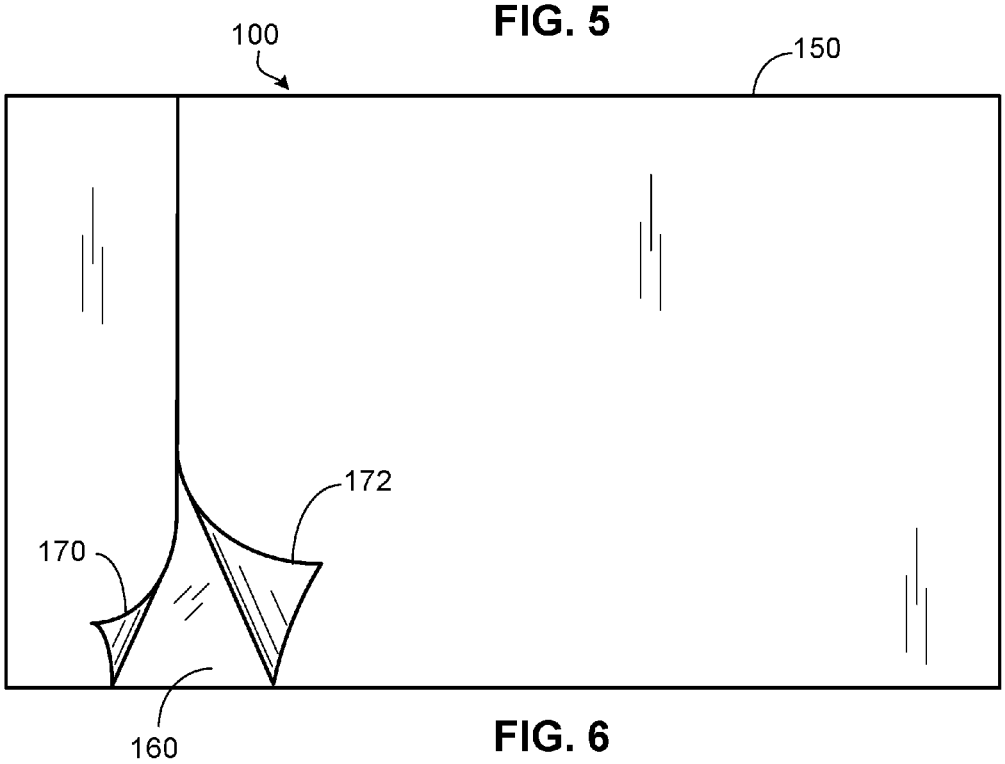
Figure 7:
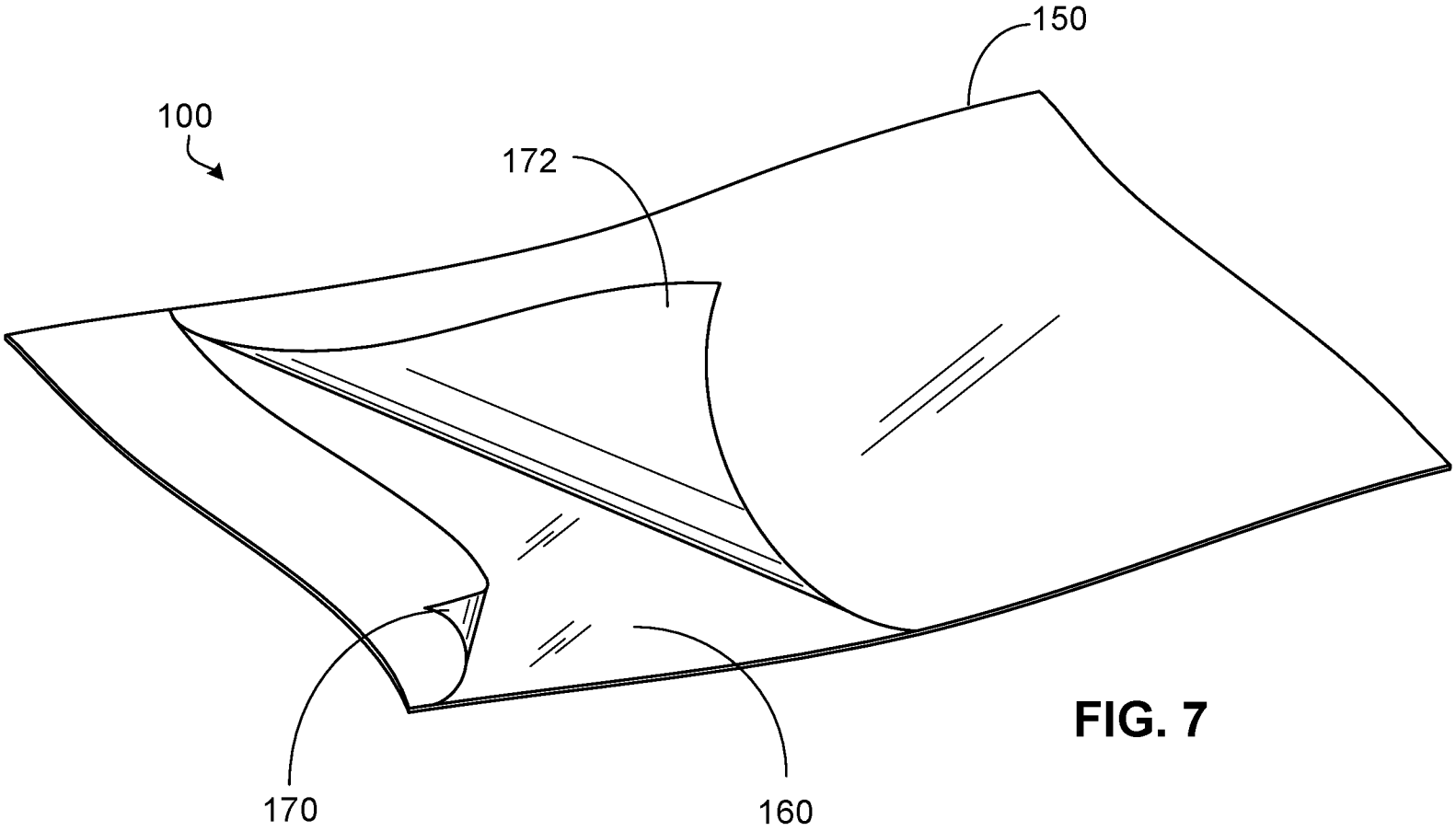
FIG. 7 illustrates a perspective view of the back side of an example resealable packing-list-pouch.
Figure 8:
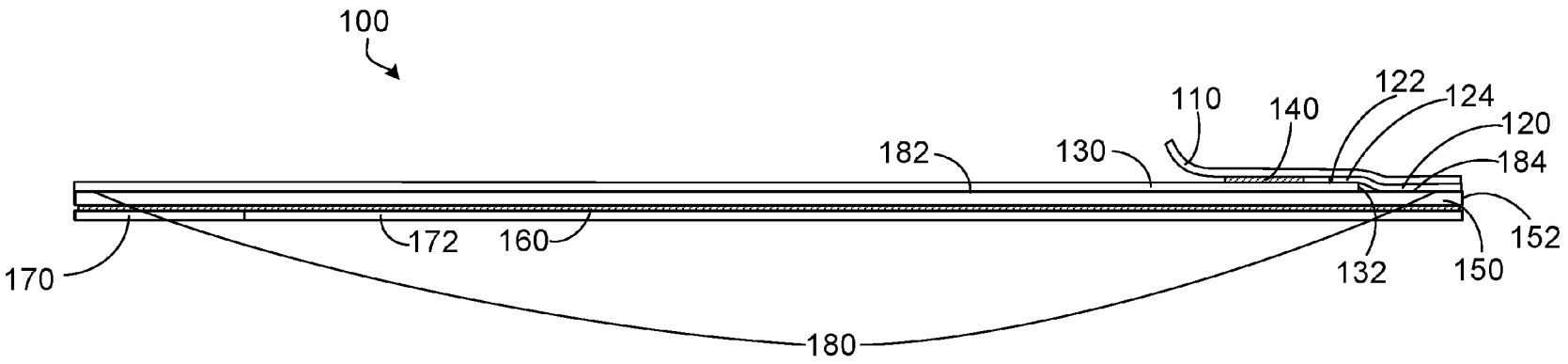
FIG. 8 illustrates a cross-sectional side view of an example resealable packing-list-pouch with the flap sheet closed.
Figure 9:
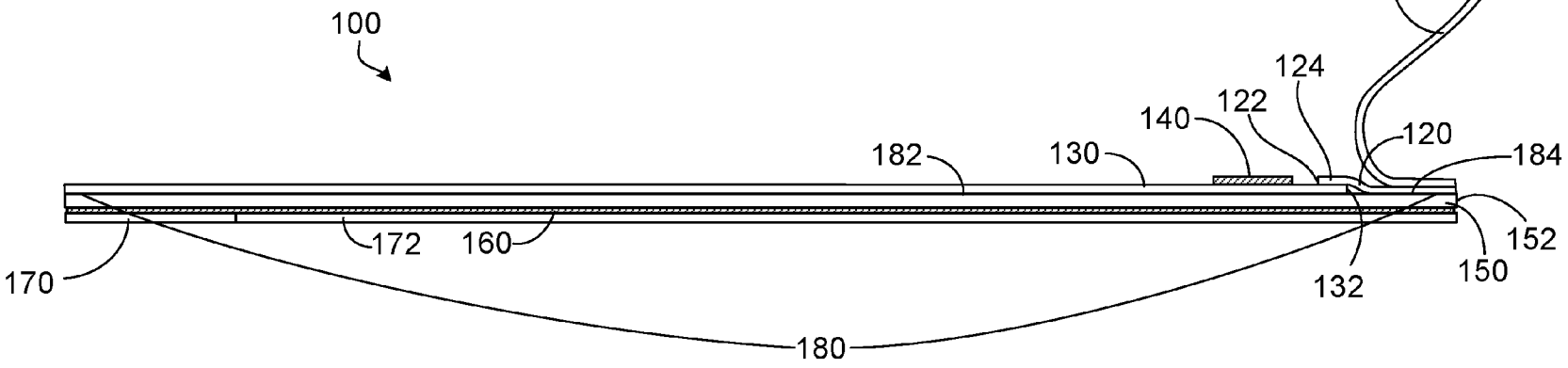
FIG. 9 illustrates a cross-sectional side view of an example resealable packing-list-pouch with the flap sheet open.

Turning to the figures, FIGS. 1, 2 and 3 illustrate front views of a preferred embodiment of a resealable packing-list-pouch 100, FIG. 4 illustrates a perspective view of the front side of the preferred embodiment, FIGS. 5 and 6 illustrate back views of the preferred embodiment, FIG. 7 illustrates a perspective view of the back side of the preferred embodiment, and FIGS. 8 and 9 illustrate side views of the preferred embodiment of the resealable-packing-list-pouch.

Resealable packing-list-pouch 100 comprises four plastic sheets (flap sheet 110, protective lip sheet 120, front sheet 130, and back sheet 150), adhesive strip 140, backing adhesive 160, and release liners 170 and 172. In the preferred embodiment, these plastic sheets are at least partially made of a transparent (or translucent), flexible plastic. Preferred plastic materials include polyethylene, polypropylene, and polyethylene terephthalate (PET). In the various embodiments, protective lip sheet 120, front sheet 130, back sheet 150, and flap sheet 110 are made of a polyethylene film.

Back sheet 150 and front sheet 130 are joined at their respective side and bottom edges to form a bottom portion 182 of a pocket 180 between back sheet 150 and front sheet 130. The bottom portion 182 of the pocket 180 is formed such that a top edge 152 of back sheet 150 extends beyond a top edge 132 of front sheet 130 to form an opening 188 (see FIG. 4).

Protective lip sheet 120 and back sheet 150 are joined at their respective top edges. Further, side edges of protective lip sheet 120 are joined to top portions of the respective side edges of back sheet 150 and to top portions of the respective side edges of bottom sheet 130. A bottom portion 124 of the protective lip sheet 120 covers the top edge 132 of the front sheet 130 and extends just below opening 188. Protective lip sheet 120 and back sheet 150 form a top portion 184 of the pocket 180.

Flap sheet 110 and protective lip sheet 120 are joined at their respective top edges such that the top edge of protective lip sheet 110 is between the top edge of flap sheet 120 and the top edge of back sheet 150. Resealable adhesive strip 140 adheres to an exterior surface of the front sheet 130 proximal to the bottom edge 122 of protective lip sheet 120. A bottom portion of flap sheet 110 may be sealed to front sheet 130 via resealable adhesive strip 140. When sealed to front sheet 130 via resealable adhesive strip 140, flap sheet 110 forms a closure over opening 188 (see FIGS. 1, 2, 4, and 8) and extends from the top edge of resealable packing-list-pouch 100 to cover protective lip sheet 120, opening 188, and a top portion of front sheet 120. A sealed packing-list-pouch 100 may be opened by peeling back flap sheet 110 and breaking the seal between flap sheet 110 and front sheet 130 along adhesive strip 140 (see FIG. 2). Shipping documents may then be inserted into pocket 180 through opening 188. Packing-list-pouch 100 may then be resealed by applying pressure to the bottom portion of flap sheet 110 along resealable adhesive strip 140.

In various embodiments, the joints formed between the various edges of the four plastic sheets of resealable packing-list-pouch 100 (flap sheet 110, protective lip sheet 120, front sheet 130, and back sheet 150) as described above are created through heat sealing. Heat sealing is a process of bonding materials together by applying heat and pressure together. In the preferred embodiment illustrated by FIGS. 1-9, the overlapping edges of the plastic sheets are aligned. Pressure and heat are applied adjacent to the edges to be bonded with a heated element that melts the plastic and melds the plastic sheets together. Various machines for performing heat sealing are available and operated by means of AC or DC power.

In other embodiments, the joints between the four plastic sheets of resealable packing-list-pouch 100 are created with a permanent adhesive or with a combination of heat sealing and permanent adhesive. Preferred permanent adhesives include acrylic adhesives and hot-melt adhesives. The main property that distinguishes a permanent adhesive from a resealable adhesive (such as what is used to form resealable adhesive strip 140, see below) is that once the bond of the permanent adhesive is broken, the adhesive no longer functions as an adhesive (i.e., a permanent adhesive is not resealable). Moreover, bond strength of a permanent adhesive is typically much higher than that of a resealable adhesive. For example, the bonding strength of a permanent adhesive is much higher than the force required to open the resealable adhesive without failing, separating, or pealing.

Resealable adhesive strip 140 is preferably deposited as a strip as shown in FIGS. 2-4 within a width of between 0.25 and 0.50 inches, but other sizes may be used. Resealable adhesive strip 140 may be made of pressure-sensitive or contact adhesive material, such as acrylic, natural, and/or synthetic rubber. Preferably, the material used to create resealable adhesive strip 140 has an adequate peel strength, which is the average load per unit width of bond line required to separate bonded materials, such as front sheet 130 and flap sheet 110, where the angle of separation is 180 degrees. In the preferred embodiment, resealable adhesive strip 140 has enough adhesion strength to survive the roughness of the shipping environment in order to prevent the flap sheet 110 from rubbed open and/or ripping off. At the same time, flap sheet 110 is still able to be unsealed with normal efforts by someone needing to open resealable packing-list-pouch 100 (i.e., the force required to separate flap sheet 110 from front sheet 130 along the resealable adhesive strip 140 does not damage or cause tearing of the plastic). The material used to create resealable adhesive strip 140 leaves little to no residue on the bottom surface of flap sheet 110 after each opening and resealing of resealable packing-list-pouch 100. The bottom surface of flap sheet 130 adhering to resealable adhesive strip 140 may be coated with a lacquer material, such as silicone, to prevent transfer of adhesive from the top surface of front sheet 130 to the bottom surface of flap sheet 110.

In alternative embodiments, an adhesive strip release liner (not shown in Figures) may be attached to adhesive strip 140. The adhesive strip release liner may be formed of a paper material coated with a release agent such as silicone. The adhesive strip release liner would be removed before closing the resealable packing-list-pouch 100 by sealing flap sheet 110 to front sheet 130 via the exposed adhesive strip 140.

In various embodiments, resealable adhesive strip 140 may be a double-sided adhesive tape (i.e., a plastic strip/carrier) with a permanent adhesive, such as an acrylic adhesive or a hot-melt adhesive, on one side and the resealable adhesive on the other side. In such embodiments, the permanent adhesive side of the tape may be adhered to the exterior surface of front sheet 130 proximal to the bottom edge 122 of protective lip sheet 120 thereby leaving the resealable adhesive side to form the resealable closure with flap sheet 110.

In alternative embodiments, resealable adhesive strip 140 may be adhered to the bottom surface of flap sheet 110 and a lacquer material applied to the exterior surface of the front sheet 130. In other alternative embodiments, an adhesive strip, such as adhesive strip 140, may be applied to both surfaces (i.e., the exterior surface of front sheet 130 and the bottom surface of flap sheet 110).

Backing adhesive 160 may be coated on the exterior side of back sheet 150 (see FIG. 6) and preferably covers the majority, if not the entirety, of the exterior side of back sheet 150. In alternative embodiments, backing adhesive 160 is applied along the edges of or in strips on the exterior side of back sheet 150. Backing adhesive 160 is formed of an adhesive material such as a hot-melt adhesive.

Release liners 170 and 172 are attached to the exterior surface of back sheet 150 via backing adhesive 160 to cover and protect the backing adhesive 160 until resealable packing-list-pouch 100 is ready to be attached to a receiving surface (see FIGS. 5-9). Release liners 170 and 172 may be formed of a paper material coated with a release agent such a silicone. Release liners 170 and 172 may be removed at which time backing adhesive 160 may be employed to attach resealable packing-list-pouch 100 to a receiving surface of a shipping container (e.g., package, envelope, or box). In an alternative embodiment, a single release liner (i.e., a single sheet of paper material coated with a release agent such as silicone) may be employed for both release liners 170 and 172.

In an alternative embodiments, the bottom edge of protective lip sheet is proximate to or butts up against the top of front sheet (i.e., at the opening of the pocket) so that the bottom portion of the protective lip sheet does not cover the opening of the formed pocket. In other alternative embodiments, a resealable packing-list-pouch is formed with a front sheet and a back sheet of equal or nearly equal size by joining the respective top, bottom, and side edges. In these embodiments, an opening is formed in the front sheet, by (for example) slicing or cutting, between the top edge of the front sheet and the adhesive strip. The opening extends from proximately one side edge to proximately the other side edge of the front strip.

While this specification contains many specific implementation details, these should not be construed as limitations on the scope of any invention or on the scope of what may be claimed, but rather as descriptions of features that may be specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub combination or variation of a sub-combination.

While this document contains many specific implementation details, these should not be construed as limitations on the scope of what may be claimed, but rather as descriptions of features that may be specific to particular implementations or embodiments. Certain features that are described in this specification in the context of separate embodiments can also be implemented in combination in a single embodiment. Conversely, various features that are described in the context of a single embodiment can also be implemented in multiple embodiments separately or in any suitable sub combination. Moreover, although features may be described above as acting in certain combinations and even initially claimed as such, one or more features from a claimed combination can, in some cases, be excised from the combination, and the claimed combination may be directed to a sub combination or variation of a sub combination.

The invention claimed is:

1. A resealable packing-list-pouch comprising:

a back sheet;

a front sheet attached to the back sheet at respective side and bottom edges to form a bottom portion of a pocket between the back sheet and the front sheet such that a top edge of the back sheet extends beyond a top edge of the front sheet to form an opening of the pocket;

a protective lip sheet attached to the back sheet at the top edge of the back sheet and such that side edges of the protective lip sheet attaches to upper portions of the side edges of the back sheet to form a protective lip over the opening of the pocket, wherein a bottom edge of the protective lip sheet covers the top edge of the front sheet and forms a top portion of the pocket between the back sheet and the protective lip sheet;

a flap sheet connected to the protective lip sheet such that a portion of the protective lip sheet is between the flap sheet and the back sheet; and an adhesive strip located on an exterior surface of the front sheet proximal to the bottom edge of the protective lip sheet such that the adhesive strip is configured to fasten a bottom portion of the flap sheet to the front sheet to form a resealable closure over the opening of the pocket and the protective lip sheet.

2. The resealable packing-list-pouch of claim 1 further comprising an adhesive coating located on an exterior surface of the back sheet.

3. The resealable packing-list-pouch of claim 2 further comprising a release liner attached to the exterior surface of the back sheet via adhesive coating such that the release liner is removable.

4. The resealable packing-list-pouch of claim 1, wherein the adhesive strip is comprised of pressure sensitive material.

5. The resealable packing-list-pouch of claim 4, wherein the pressure sensitive material is acrylic, natural rubber, or synthetic rubber.

6. The resealable packing-list-pouch of claim 1, wherein the back sheet, the front sheet, the protective lip sheet, and the flap sheet are formed of a flexible plastic.

7. The resealable packing-list-pouch of claim 6, wherein the flexible plastic is polyethylene.

8. The resealable packing-list-pouch of claim 6, wherein the flexible plastic is transparent.

9. The resealable packing-list-pouch of claim 1, wherein the front sheet, the back sheet, the protective lip sheet, and the flap sheet are attached via heat sealing.

10. The resealable packing-list-pouch of claim 1, wherein the front sheet, the back sheet, the protective lip sheet, and the flap sheet are attached via a permanent adhesive.

11. The resealable packing-list-pouch of claim 10, wherein the permanent adhesive is an acrylic adhesives or a hot-melt adhesive.

12. A method of making a resealable packing-list-pouch, the method comprising:

forming a back sheet, a front sheet, a flap sheet, and a protective lip sheet out of a flexible plastic material;

forming a pocket by attaching the front sheet to the back sheet at respective side and bottom edges such that a top edge of the back sheet extends beyond a top edge of the front sheet to form an opening of the pocket;

attaching the protective lip sheet to the back sheet at one end and such that side edges of the protective lip sheet affix to upper portions of the side edges of the back sheet to form a protective lip over the opening of the pocket, wherein a bottom edge of the protective lip sheet covers the top edge of the front sheet;

attaching the flap sheet to the protective lip sheet such that a portion of the protective lip sheet is between the flap sheet and the back sheet; and placing an adhesive strip on an exterior surface of the front sheet proximal to the bottom edge of the protective lip sheet such that the adhesive strip is configured to fasten a bottom portion of the flap sheet to the front sheet to form a resealable closure over the opening of the pocket and the protective lip sheet.

13. The method of claim 12 further comprising:

forming an adhesive coat on an exterior surface of the back sheet; and attaching a release liner to the exterior surface of the back sheet via the adhesive coat such that the release liner is removable.

14. The method of claim 12, wherein the flexible plastic is polyethylene.

15. The method of claim 12, wherein the front sheet, the back sheet, the protective lip sheet, and the flap sheet are attached via heat sealing.

16. A resealable packing-list-pouch comprising:

a back sheet and a front sheet connected to form a pocket such that a top edge of the back sheet extends beyond a top edge of the front sheet to form an opening of the pocket;

a protective lip sheet connected to the back sheet at one end to form a protective lip over the opening of the pocket;

a flap sheet connected to the protective lip sheet; and an adhesive strip configured to fasten a bottom portion of the flap sheet to the front sheet to form a resealable closure over the opening of the pocket.

17. The resealable packing-list-pouch of claim 16, wherein a bottom portion of the protective lip sheet covers the top edge of the front sheet.

18. The resealable packing-list-pouch of claim 16, wherein the adhesive strip is located on an exterior surface of the front sheet proximal to a bottom edge of the protective lip sheet.

19. The resealable packing-list-pouch of claim 16, wherein the adhesive strip is located on an interior surface of the flap sheet proximal to a bottom edge of the flap sheet.

20. The resealable packing-list-pouch of claim 16 further comprising a release liner attached to an exterior surface of the packing-list-pouch via an adhesive coat such that the release liner is removable.

* * * * *